US005803171A

United States Patent [19]

McCaffery et al.

[11] Patent Number: 5,803,171

[45] Date of Patent: Sep. 8, 1998

[54] MODIFIED CONTINUOUS DRIVE DRAINAGE PROCESS

[75] Inventors: William J. McCaffery; Grant W. Boyd; Andrew J. Fox; Wayne P. Kraus, all of Calgary; Bryan D. Weir, Airdrie, all of Canada

[73] Assignee: Amoco Corporation, Chicago, Ill.

[21] Appl. No.: 682,644

[22] PCT Filed: Sep. 29, 1995

[86] PCT No.: PCT/US95/12578

§ 371 Date: Jul. 26, 1996

§ 102(e) Date: Jul. 26, 1996

[87] PCT Pub. No.: WO97/12119

PCT Pub. Date: Apr. 3, 1997

[51] Int. Cl.[6] ..... E21B 43/00; E21B 43/30; E21B 43/24

[52] U.S. Cl. ..... 166/245; 166/50; 166/263; 166/268

[58] Field of Search ..... 166/50, 245, 263, 166/268

[56] References Cited

U.S. PATENT DOCUMENTS

| | | | |
|---|---|---|---|
| 3,024,013 | 3/1962 | Rogers et al. . | |
| 3,155,160 | 11/1964 | Craig, Jr. et al. . | |
| 3,338,306 | 8/1967 | Cook | 166/40 |
| 3,434,544 | 3/1969 | Satter et al. | 166/303 |
| 3,439,742 | 4/1969 | Durle | 166/272 |
| 3,554,285 | 1/1971 | Meldau | 166/256 |
| 3,572,436 | 3/1971 | Riehl | 166/263 |
| 3,771,598 | 11/1973 | McBean | 166/245 |
| 3,796,262 | 3/1974 | Allen et al. | 166/272 |
| 3,878,891 | 4/1975 | Hoyt | 166/245 |
| 4,085,803 | 4/1978 | Butler | 166/272 |
| 4,116,275 | 9/1978 | Butler et al. | 166/303 |
| 4,121,661 | 10/1978 | Redford | 166/272 |

(List continued on next page.)

FOREIGN PATENT DOCUMENTS

| | | | |
|---|---|---|---|
| 0211883 | 9/1955 | Australia . | |
| 0681162 | 5/1964 | Canada | 166/35 |
| 1004593 | 2/1977 | Canada | 166/37 |
| 1304287 | 6/1992 | Canada | 166/39 |
| 0356344 | 1/1973 | U.S.S.R. . | |
| 1816852 | 10/1989 | U.S.S.R. . | |
| 2012783 | 11/1990 | U.S.S.R. . | |
| 0511768 | 8/1939 | United Kingdom . | |
| 0852769 | 11/1960 | United Kingdom . | |

OTHER PUBLICATIONS

Gaskell, M. H. and Lindley, D. C., "Cellar Oil", Journal of Petroleum Technology, (Apr., 1961), pp. 377–385.

Keplinger, C. H., "Economic Considerations Affecting Steam Flood Prospects", Producers Monthly, vol. 29, No. 5, May 1965.

Buckles, R. S., "Steam Stimulation Heavy Oil Recovery At Cold Lake, Alberta", SPE 7994, 1979.

(List continued on next page.)

*Primary Examiner*—Roger J. Schoeppel

*Attorney, Agent, or Firm*—James A. Gabala; Robert E. Sloat

[57] ABSTRACT

A method of producing hydrocarbons from a subterranean formation. The method includes the steps of: building an array of at least three horizontal wells; establishing injectivity in the formation; establishing communication between adjacent horizontal sections of wells in the array; injecting a fluid through the horizontal section of an outer well in the array while producing hydrocarbons and associated fluids through the horizontal section of a well immediately adjacent to the outer well; and simultaneously applying the steps of injecting and producing to adjacent remaining pairs of wells in the array so that with respect to any particular well in the array, that is being used for fluid injection, each well in the array immediately adjacent to it is being used for fluid production, and wherein the hydrocarbons and associated fluids are produced at a cumulative rate of production from the entire array that establishes a pressure differential between the wells in the array, and wherein the cumulative rate of fluid production from the array is greater than the cumulative rate of fluid injection through the array.

31 Claims, 4 Drawing Sheets

U.S. PATENT DOCUMENTS

| | | | |
|---|---|---|---|
| 4,127,170 | 11/1978 | Redford | 166/252 |
| 4,127,172 | 11/1978 | Redford et al. | 166/261 |
| 4,160,481 | 7/1979 | Turk et al. | 166/245 |
| 4,248,302 | 2/1981 | Churchman | 166/272 |
| 4,249,777 | 2/1981 | Morrell et al. | 299/2 |
| 4,257,650 | 3/1981 | Allen | 166/245 |
| 4,265,485 | 5/1981 | Boxerman et al. | 166/272 |
| 4,283,088 | 8/1981 | Tabakov et al. | 299/2 |
| 4,296,969 | 10/1981 | Willman | 299/2 |
| 4,324,291 | 4/1982 | Wong et al. | 166/272 |
| 4,344,485 | 8/1982 | Butler | 166/259 |
| 4,368,781 | 1/1983 | Anderson | 166/252 |
| 4,385,662 | 5/1983 | Mullins et al. | 166/263 |
| 4,410,216 | 10/1983 | Allen | 166/50 |
| 4,434,849 | 3/1984 | Allen | 166/250 |
| 4,463,988 | 8/1984 | Bouck et al. | 299/2 |
| 4,510,997 | 4/1985 | Fitch et al. | 166/50 |
| 4,522,260 | 6/1985 | Wolcott, Jr. | 166/50 |
| 4,577,691 | 3/1986 | Huang et al. | 166/263 |
| 4,598,770 | 7/1986 | Shu et al. | 166/272 |
| 4,633,948 | 1/1987 | Clossmann | 166/50 |
| 4,696,345 | 9/1987 | Hsueh | 166/50 |
| 4,700,779 | 10/1987 | Huang et al. | 166/50 |
| 4,702,314 | 10/1987 | Huang et al. | 166/245 |
| 4,705,431 | 11/1987 | Gadelle et al. | 405/267 |
| 4,727,937 | 3/1988 | Shum et al. | 166/50 |
| 4,733,726 | 3/1988 | Alameddine et al. | 166/263 |
| 4,850,429 | 7/1989 | Mims et al. | 166/50 |
| 5,016,709 | 5/1991 | Combe et al. | 166/50 |
| 5,033,546 | 7/1991 | Combe | 166/245 |
| 5,123,488 | 6/1992 | Jennings, Jr. | 166/50 |
| 5,148,869 | 9/1992 | Sanchez | 166/50 |
| 5,209,295 | 5/1993 | Campos et al. | 166/272 |
| 5,211,230 | 5/1993 | Ostapovich et al. | 166/50 |
| 5,215,146 | 6/1993 | Sanchesz | 166/50 |
| 5,244,041 | 9/1993 | Renard et al. | 166/50 |
| 5,273,111 | 12/1993 | Brannan et al. | 166/50 |
| 5,314,615 | 5/1994 | Campos et al. | 208/370 |
| 5,318,124 | 6/1994 | Ong et al. | 166/50 |
| 5,339,897 | 8/1994 | Leaute | 166/50 |
| 5,381,863 | 1/1995 | Wehner | 166/263 |
| 5,413,175 | 5/1995 | Edmunds | 166/303 |
| 5,417,283 | 5/1995 | Ejiogu et al. | 166/272 |

OTHER PUBLICATIONS

"Kern River 'Hotplate' Project Launched", Oil & Gas Journal, Aug. 23, 1982.

Joshi, S. D. and Threlkeld, C. B., "Laboratory Studies of Thermally Aided Gravity Drainage Using Horizontal Wells", Mar. 18, 1985.

Joshi, S. D., "A Review of Thermal Oil Recovery Using Horizontal Wells", IN SITU, 11(2&3), pp. 211–259, 1987.

Nasar, T. N., Analysis of Thermal Horizontal Well Recovery and horizontal Well Bibliography, Report #9091–12, Nov., 1990.

Saltuklaroglu, M., Temperature to Pressure Analogy Helps to Understand Mocan's Cold Lake Horizontal Well Process, Third Annual MOCAN Engineering/Geoscience Technology Conference, Nov. 6–7, 1991, Calgary.

Sawhney, G.. S., "Steam–Assisted Gravity Drainage with Vertical Steam Injection Wells", Department of Chemical and Petroleum Engineering, Calgary, Alberta, Oct., 1993.

Arthur, J. E., Best, D. A. and Lesage, R. P., "A Model Describing Steam Circulation in Horizontal Wellbores", SPE Production & Facilities, Nov., 1993.

Redford, D. A. and Luhning, R. W., In Situ recovery from the Athabasca Oil Sands—Past Experience and Future Potential, Part II,,Forty–Sixth Annual Technical Meeting of The Petroleum Society of CIM in Banff, Paper 95–24, May 14–17, 1995.

Donnelly, J. K. and Chmilar, M. J., "The Commercial Potential of Steam Assisted Gravity Drainage", International Heavy Oil Symposium, Calgary, Alberta, Canada, Jun. 19–21, 1995.

MODIFIED CONTINUOUS DRIVE DRAINAGE PROCESS

TECHNICAL FIELD

This invention relates to the general subject of methods for recovering hydrocarbons from subterranean formations, and in particular, to methods and processes for recovering heavy oil by means of injecting fluids into the formation.

BACKGROUND OF THE INVENTION

It is well known that liquid hydrocarbons, commonly known as crude oils, found in subterranean formations vary considerably as to viscosity and specific gravity. Crude oils with an API gravity of 22 degrees or less are generally considered to be heavy crude oils. As heavy crude oils are more difficult to treat, transport and refine than lighter crude oils, the market value of heavy crude oils has been traditionally lower than the value of lighter crude oils.

It is also known that the composition and condition of the subterranean formations in which crude oils are found vary a great deal. Hydrocarbon bearing formations can varying in physical composition from consolidated rock to unconsolidated sands, which may affect permeability and porosity. Natural layering and mixing of a variety of natural impermeable materials within a subterranean formation can also occur. The presence of diagenetic clay, or impermeable partial barriers such as mud or mud stone laminations, or calcite lenses within a subterranean formation may affect the ability of hydrocarbons to flow within the formation.

In subterranean formations of optimal characteristics and compositions, due to the higher viscosity of heavy crude oils, the application of conventional primary, secondary and tertiary production techniques and technologies may not enable economic recovery of heavy crude oils. Where heavy crude oil contained within a subterranean formation will initially flow at economic rates to and into the bore hole of a well under natural reservoir conditions, usually less than 7% of the oil contained within the formation can be produced by conventional means. Achieving rates and volumes of recovery from a subterranean formation containing heavy crude oil, comparable to a similar formation containing lighter crude oil, can in general, only be accomplished at a higher production cost.

In order to improve the economics of producing heavy crude oils, it has been well understood that the introduction of heat, solvents or artificial pressure into a subterranean reservoir containing heavy crude oil, can significantly increase the amount of heavy crude oil recovered and rate recovery of such oil, from such formation. See:

Redford, D. A. and Luhning, R. W., "In Situ Recovery from the Athabasca Oil Sands - Past Experience and Future Potential, Part II", Paper 95-24 published and delivered at the 46th Annual Meeting of the Petroleum Society of CIM, May 14–17, 1995;

Nasar, T. N., "Analysis of Thermal Horizontal Well Recovery And Horizontal Well Bibliography", November 1990, Report #9091-12, Oil Sands and Hydrocarbon Recovery Department, Alberta Research Council; and Joshi, S. D., A Review of Thermal Recovery Using Horizontal Wells, In-Situ. 11 (2&3), 211–259 (1987).

The current state of the art reflects both an evolution of technology through general innovative improvement as well as innovation to meet conditions encountered in specific heavy crude, oil bearing subterranean formations.

There are many methods proposed in the art for producing heavy crude oils. See:

U.S. Pat. No. 3,155,160 to Craig et al.,
U.S. Pat. No. 3,338,306 to Cook,
U.S. Pat. No. 3,434,544 to Satter et al.,
U.S. Pat. No. 3,878,891 to Hoyt,
U.S. Pat. No. 4,024,013 to Rogers et al.,
U.S. Pat. No. 4,085,803 to Butler,
U.S. Pat. No. 4,116,275 to Butler et al.,
U.S. Pat. No. 4,121,661 to Redford,
U.S. Pat. No. 4,127,170 to Redford,
U.S. Pat. No. 4,127,172 to Redford et al.,
U.S. Pat. No. 4,248,302 to Churchman,
U.S. Pat. No. 4,324,291 to Wong et al.,
U.S. Pat. No. 4,385,622 to Mullins et al.,
U.S. Pat. No. 4,368,781 to Anderson,
U.S. Pat. No. 4,410,216 to Allen,
U.S. Pat. No. 4,434,849 to Allen,
U.S. Pat. No. 4,463,988 to Bouck et al.,
U.S. Pat. No. 4,510,997 to Fitch et al.,
U.S. Pat. No. 4,522,260 to Wollcoft, Jr.,
U.S. Pat. No. 4,696,345 to Hsueh,
U.S. Pat. No. 4,702,314 to Huang et al.,
U.S. Pat. No. 4,733,726 to Alameddine et al.,
U.S. Pat. No. 4,727,937 to Shum et al.,
U.S. Pat. No. 5,209,295 to Campos et al.,
U.S. Pat. No. 5,211,230 to Ostapovich et al.,
U.S. Pat. No. 5,314,615 to Campos et al.,
U.S. Pat. No. 5,339,897 to Leaute,
U.S. Pat. No. 5,381,863 to Wehner,
U.S. Pat. No. 5,417,383 to Ejiogu et al.,
Canadian 1,004,593 to Wang et al., and
Gr. Brit. 511,768 to Benson Many methods teach the injection of a heated fluid, preferably steam, into the subterranean formation containing the heavy crude oil (the reservoir), through arrays of horizontal well bores, drilled from the surface:

U.S. Pat. No. 3,572,436 to Riehl,
U.S. Pat. No. 4,160,481 to Turk et al.,
U.S. Pat. No. 4,257,650 to Allen,
U.S. Pat. No. 4,283,088 to Tabakov et al.,
U.S. Pat. No. 4,296,969 to Willman,
U.S. Pat. No. 4,344,485 to Butler,
U.S. Pat. No. 4,577,691 to Huang et al.,
U.S. Pat. No. 4,598,770 to Hartman et al.,
U.S. Pat. No. 4,633,948 to Philip et al.,
U.S. Pat. No. 4,700,779 to Huang et al.,
U.S. Pat. No. 4,850,429 to Mimms et al.,
U.S. Pat. No. 5,016,709 to Combe et al.,
U.S. Pat. No. 5,033,546 to Combe,
U.S. Pat. No. 5,123,488 to Jennings,
U.S. Pat. No. 5,148,869 to Sanchez,
U.S. Pat. No. 5,215,146 to Sanchez,
U.S. Pat. No. 5,244,041 to Renard et al.,
U.S. Pat. No. 5,273,111 to Brannan et al.,
U.S. Pat. No. 5,318,124 to Ong et al.,
U.S. Pat. No. 5,413,175 to Edmunds, Canadian 1,304,287 to Edmunds et al.; and SU 1,816,852 to Kazan Phys. Tech. Inst.

Keplinger, C. H., "Economic Considerations Affecting Steam Flood Prospects", *Producers Monthly,* Vol. 29, No. 5, May 1965, pp. 14–20, Gaskell, M. H. and Lindley, D. C., "Cellar Oil", *Journal of Petroleum Technology,* April 1961, pp. 377–382, Joshi, S. D. and Threlkeld C. B., "Laboratory Studies of Thermally Aided Gravity Drainage Using Horizontal Wells", *AOSTRA Journal of Research,* Vol. 2, Number 1, 1985, pages 11–19, and Donnelly, J. K. and Chmilar, M. J., "The Commercial Potential of Steam Assisted Gravity Drainage", *SPE* 30278, presented at the International Heavy Oil Symposium, Calgary, Alberta, Jun. 19–21, 1995.

With the exception of U.S. Pat. No. 5,273,111 to Brannan et al (hereinafter "the Brannan Patent", and which is assigned to Amoco Corporation) and U.S. Pat. No. 5,318,124 to Ong et al. (hereinafter "the Ong Patent"), the cited prior art teaches either a gravity drainage effect, or a vertical or horizontal sweep of the oil within the reservoir. The Ong Patent teaches the injection of steam through horizontal injection wells located above horizontal production wells, at different pressures with the intention of creating a mild pressure drive to supplement gravity drainage of oil within the reservoir to lower production wells. The Brannan Patent teaches a method combining steam assisted gravity drainage and a significant vertical and horizontal sweeping of oil within the reservoir.

The process and invention taught to the Ong Patent is intended to be applied to the production of oil from a reservoir where the oil is sufficiently immobile such that the reservoir is considered impermeable. By contrast, the process and invention taught by the Brannan Patent is intended to be applied to the production of oil from a reservoir containing oil which is mobile to some extent within the reservoir prior to the application of such process and invention.

The Brannan Patent teaches that the use of horizontal injection and production wells in a pattern where the horizontal sections of the wells are parallel but offset from one another in the vertical plane, with the horizontal section of the injection wells being placed in the reservoir above the horizontal sections of the production wells, with the horizontal sections of the production wells being drilled in the reservoir at a point between the base of the reservoir and the midpoint of the reservoir. Steam is injected on a continuous basis through the upper injection wells, while oil is produced through the lower production wells, at a rate which greater than the cumulative rate at which steam is injected into the upper horizontal wells.

Primary production operations, following and utilizing the process and invention taught by the Brannan Patent have been conducted by Amoco Canada Petroleum Company Ltd. on a seven well pilot project at the Primrose Lake Air Weapons Range in northeast Alberta, Canada. The production of heavy crude oil from the Clearwater Formation underlying lands within the Primrose Range was an objective. API gravity of oil within this subterranean reservoir at the Primrose site varies from 100 to 120 degrees. Viscosity varies from 30,000 centipoises, at the top of the reservoir, to over 100,000 centipoises, at the bottom of the reservoir, all at the reservoir's native temperature of 14° C. Early results indicated that, due to the presence of bio-turbated interbedded sands and muds within the Clearwater Formation at this location, thermal and pressure communication between the upper injection wells and the lower production wells did not occur as rapidly as predicted. Therefore, before commencing Continuous Steam Injection (CSI) in the upper wells and Continuous Production (CP) of fluids from the lower wells, a Cyclic Steam Stimulation (CSS, sometimes, called "huff and puff") program involving all wells, was implemented.

The use of such a process to increase mobility and enhance injectivity thereby increasing communication between the production wells and the injection wells, is disclosed in the Brannan Patent. Accordingly, application of CSI in the upper wells and CP from the lower wells will not be applied until CSS provides sufficient thermal and pressure communication between the upper injection wells and the lower production wells. Moreover, the prior art, for the most part, teaches the use of CSS in a fashion where all wells in an array would be subject to the same phase (i.e., steam injection phase, soak period or fluid production phase) of the process, at the same time (i.e., the wells are "in sync"). For example, see U.S. Pat. Nos. 4,257,650 to Allen and 4,160,481 to Turk et al., and the publication by B. Williams, "Kern River Hotplate Project Launched", *Oil and Gas Journal,* Aug. 23, 1982, pages 51–54. The Ong Patent teaches the initial and continuous injection of steam through the injection wells in the array, with the application of out of sync CSS to only the production wells in the array for the purpose of creating a permeable path between the injection wells and the production wells. Furthermore, the Ong Patent teaches that CSS may be applied to the production wells either out of sync or in sync, with no stated preferred method or any appreciation of any benefit of such an application.

Amoco found that, where CSS is applied prior to the application CSI in a well array as taught by the Brannan Patent, the efficiencies of using CSS may not always be fully realized. Inasmuch as the purpose of using CSS is to create communication between the producers and injectors, alternate steaming and producing of the upper wells may result in the creation of a steam chamber that pre-maturely contacts the top of the subterranean formation in which the horizontal section of the upper wells is located (See FIG. 3 herein). In particular, creation of such steam chambers 14*a,* 14*b* and 14*c* at the top of the reservoir formation 12, before there is thermal communication between the upper wells 2*a,* 2*b* and 2*c* and the lower wells 4*a* and 4*b,* may result in the excessive loss of heat to the over burden. See G. S. Sawhney, ("Steam-Assisted Gravity Drainage with Vertical Steam Injection Wells", National Library of Canada, TN 871 S29, 1993) for an analysis of the growth of a steam chamber in a subterranean formation containing heavy crude oil.

Thus, while the method and process of the Brannan Patent can be applied effectively under certain conditions, there are reservoir conditions where the method and process of the Brannan Patent needs further development and improvement.

SUMMARY OF THE INVENTION

In accordance with the present invention, a method is provided for producing hydrocarbons from a subterranean formation. The method comprises the steps of: (i) building an array of at least three horizontal wells, wherein the horizontal sections of all wells in the array are generally located in the bottom-half of the formation, are relatively parallel to one another, and are essentially horizontally co-planar with each other; (ii) establishing injectivity in the formation; (iii) creating thermal and pressure communication between adjacent wells in the array without inducing fractures in the formation; (iv) continuously injecting a fluid through the first outer well in the array; continuously producing hydrocarbons and associated fluids through the well immediately adjacent to such outer well; and (vi) simultaneously applying the steps of continuously injecting and continuously producing to adjacent remaining pairs of wells in the array so that each well in the array subject to continuous injection is offset only by wells subject to continuous production, wherein the hydrocarbons and associated fluids are produced at a cumulative rate of production such that a pressure differential is established between the wells in the array used for production and the wells in the array used for injection, and the cumulative rate of fluid production is greater than the cumulative rate of fluid injection.

To create thermal and pressure communication between adjacent wells, the present invention teaches the application of CSS to groups or arrays of three or more substantially coplanar and parallel horizontal wells, by conducting the injection phase, soak period and production phase of each well, "out of sync" with the wells located immediately adjacent to it in the array. Where cyclic injection and production of fluid is required to create communication between adjacent wells in the array, the invention maximizes the benefits of using a heated fluid for injection purposes.

Once adequate thermal and pressure communication has been established between adjacent wells located in the reservoir, the present invention also facilitates recovery of oil from the reservoir through the gravity drainage of oil within the reservoir in combination with the vertical and horizontal sweeping of such oil, as taught by the Brannan Patent, without the need to drill upper injection wells.

Where communication and injectivity already exist in the formation, a fluid, such as steam, a solvent or a gas, can be injected on a continuous basis while fluid is produced on a continuous basis from the formation following the method described in the first paragraph of this summary.

The present invention teaches that, where the initial application of CSS is required to create thermal and pressure communication between injection and production wells in the array, it is preferable to apply CSS out of sync to both the injection and production wells in the array. A key advantage of the application of out of sync CSS to all wells in the array, is that thermal and pressure communication between adjacent wells is established faster at a lower capital cost than if all wells were subject to each phase of the CSS process (i.e., injection, soak period and production) at the same time. One reason for this is because the reservoir may be pressured-up and such pressurization maintained over the whole period of time that CSS is being applied. Furthermore, through the application of out of sync CSS to all wells in the array, each well undergoing the fluid production phase of the CSS cycle can benefit from increased fluid production as a result of the pressure drive created by the injection of fluids from wells that are adjacent to it and that are undergoing the fluid injection phase of the cycle. Finally, the use of out of sync CSS as taught by the invention facilitates the use smaller capacity steam generation equipment, providing immediate economic benefits through reduction of capital costs.

It should be appreciated that not all applications of the process and invention taught by the Brannan Patent require the use of CSS. Furthermore, not all applications of that process and invention, (i.e., where CSS is used to improve injectivity and initiate communication) will result in the premature formation of a steam chamber with the resultant loss of significant heat to the overburden before satisfactory thermal and pressure communication between the upper and lower wells can be created. Where there is very little viscosity difference between the oil at the top and the bottom of the reservoir, and there are no partial barriers between top and bottom of the reservoir, CSS can be effectively used to start the recovery of oil by the process and invention of the Brannan Patent.

However, where conditions in a reservoir do not favour the application of the process and invention taught by the Brannan Patent, but do support the use of a continuous vertical and horizontal drive, combined with gravity drainage to produce heavy crude oil, the present invention may be practiced as an alternative to the process and invention taught by the Brannan Patent. This would occur, for example, where the reservoir is characterized as having partial, non-continuous impermeable barriers which would hinder the vertical flow of fluids, or where the viscosity of the heavy crude oil within the reservoir may vary considerably over a large range.

Moreover, in the case of a subterranean formation bearing heavy crude oil where the extensive use of CSS is required to improve thermal and pressure communication within the reservoir, the preferred method of the present invention is to conduct CSS only in respect of horizontal wells where the horizontal section of each well is located in the lower half of the reservoir. This maximizes the efficiencies of using CSS by preventing the formation of a steam chamber that prematurely contacts the top of the reservoir. It also exposes a greater portion of the vertical cross section of the reservoir at the point of injection to the thermal effects of steam injection.

Yet another advantage of the present invention is the savings of electrical power. Where the surface pumping equipment (i.e., pumpjacks used to produce fluids from the wells) for the wells in the array are powered by electricity, a significant savings can be realized through the reduction in power usage resulting from not starting up and running the pumpjacks for all of the wells in the array at the same time.

Numerous other advantages and features of the present invention will become readily apparent from the following detailed description of the invention, the embodiments described therein, from the claims, and from the accompanying drawings.

DETAILED DESCRIPTION

Figure 1:
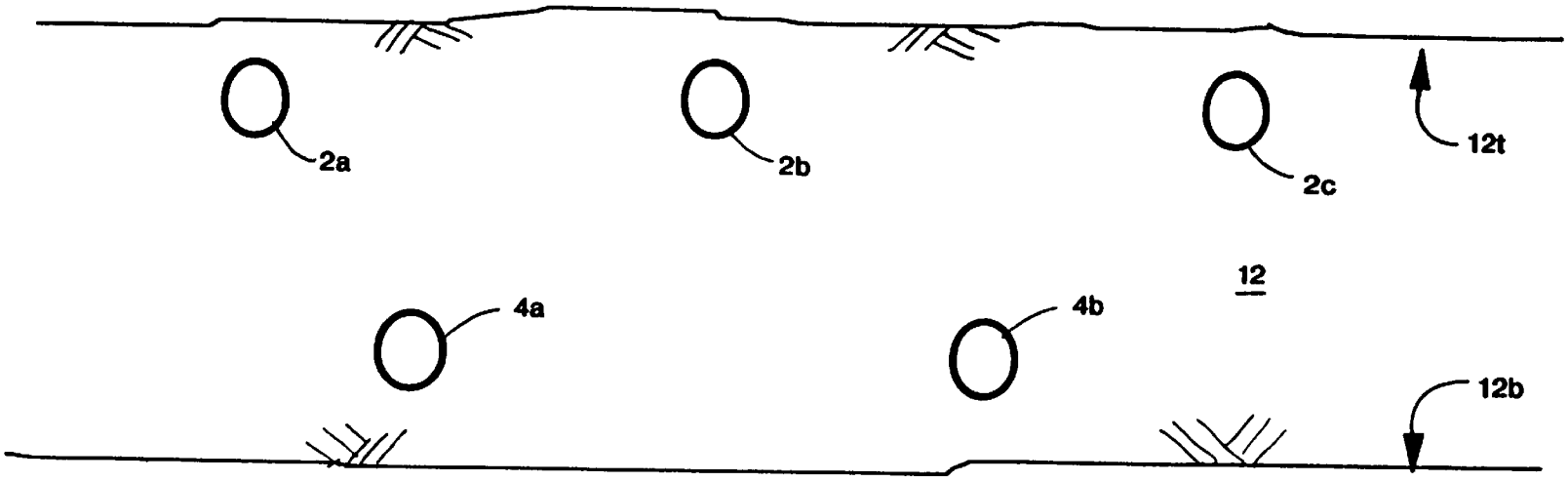
FIG. 1 PRIOR ART
FIG. 1 shows by cross section the approximate geometry of the horizontal sections wells drilled as taught by U.S. Pat. No. 5,273,111.

While this invention is susceptible of embodiment in many different forms, there is shown in the drawings, and will herein be described in detail, two specific embodiments of the invention. It should be understood, however, that the present disclosure is to be considered an exemplification of the principles of the invention and is not intended to limit the invention to any specific embodiment so described.

Figure 2:
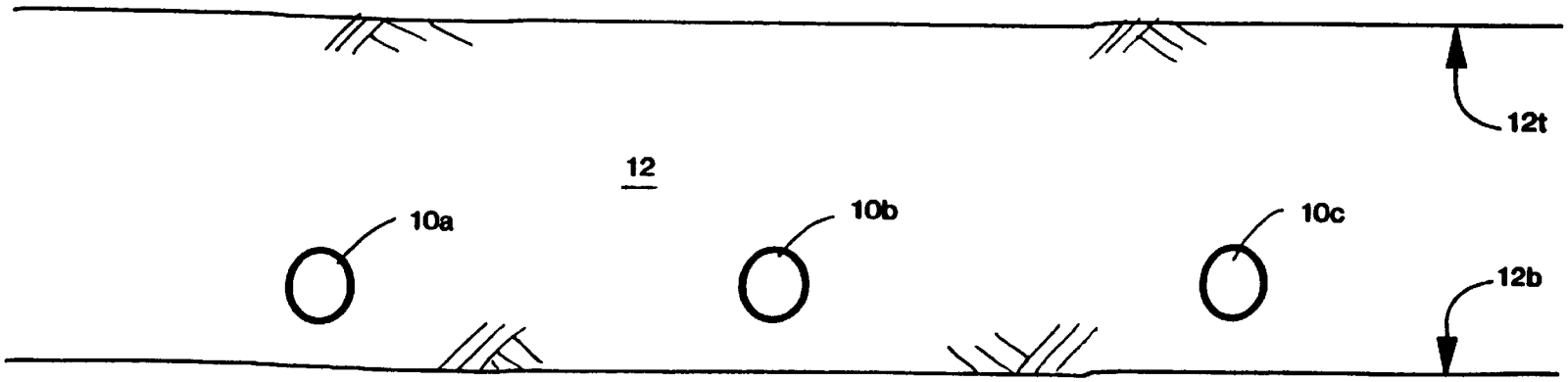
FIG. 2 shows by cross section the approximate geometry of the horizontal sections of the wells drilled as taught by the present invention.
Figure 3:
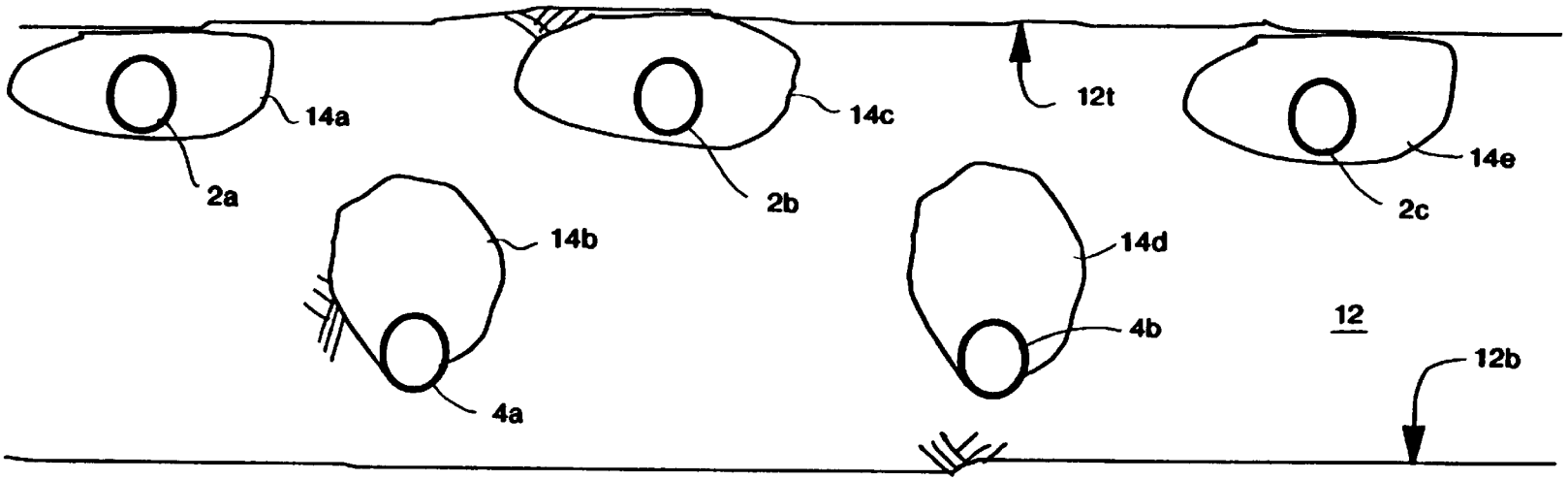
FIGS. 3 and 4 show by cross section the development of a steam chamber around each horizontal well by the application of CSS in the case of the wells drilled as taught by U.S. Pat. No. 5,273,111 (FIG. 3) and as thought by the present invention (FIG. 4)

Referring to the drawings, FIG. 2 illustrates an array consisting of at least three horizontal wells 10*a,* 10*b* and 10*c* is drilled into a formation 12 having a reservoir containing heavy crude oil. The formation 12 has a top 12*t* and a bottom 12*b*. These wells are drilled using means known in the art. The wells are drilled so that the horizontal section of each well is located between the bottom and midpoint of the reservoir. The wells are drilled so that the horizontal sections of all wells in the array are approximately equidistant, relatively parallel to one another, and horizontally coplanar with each other. With methods presently known in the art for drilling horizontal wells, the present invention allows for the horizontal section of the wells comprising the array to deviate from true parallel and true co-planar by as much as 5 meters.

By contrast the process and invention taught by U.S. Pat. No. 5,273,111 to Brannan et al. comprises a set of three upper injection wells 2*a,* 2*b* and 2*c* (See FIG. 1) and two lower production wells 4*a* and 4*b* that are drilled into the reservoir formation 12 (See FIG. 1 of U.S. Pat. No. 5,273,111). The teachings of the Brannan et al. patent are incorporated herein by reference. FIG. 1 of the present application corresponds to FIG. 1 of U.S. Pat. No. 5,273,111. The wells of FIG. 1 resemble the end points of the letter "W". Spacing between the horizontal wells in the array of Brannan et al. is not specified and may be varied depending on the nature of the reservoir and the heavy crude oil contained therein.

Figure 6:
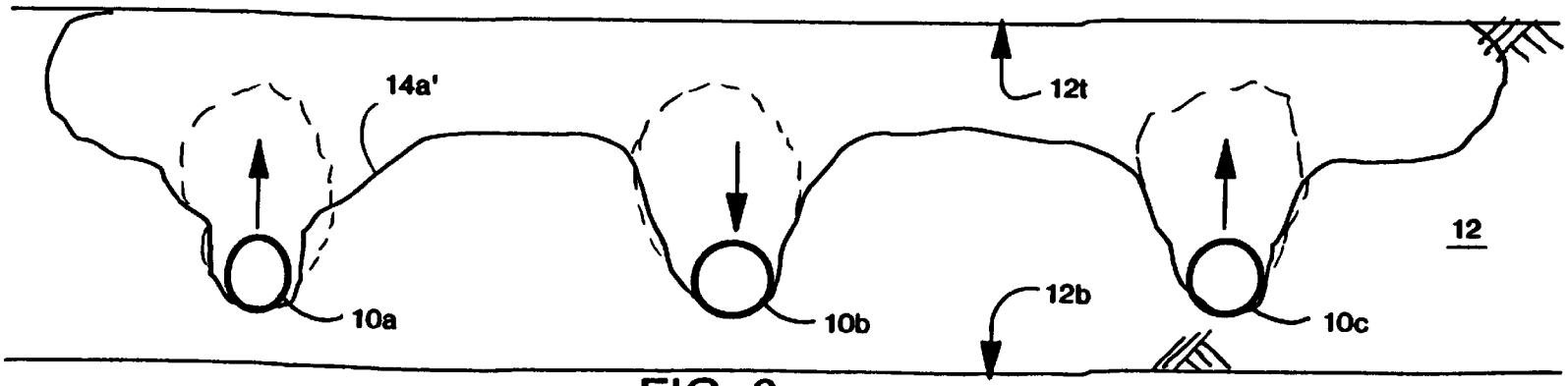

If reservoir conditions provide immediate injectivity and satisfactory communication between adjacent wells in the array, Continuous Steam Injection (CSI) can begin with the outer wells 10*a* and 10*c* in the array being used as injectors and the inner or center well 10*b* being used to continuously produce heavy crude oil (See FIG. 6). Alternatively, the outer wells may be used for continuous production and the inner well may be used for CSI. The present invention facilitates both methods, with the choice of method being determined by the nature of the particular reservoir in which the process is applied, and the characteristics of the heavy crude oil contained therein.

There are a variety of circumstances that could affect the initial decision as to which wells of FIG. 2 will be used as injectors or producers. For example, in a situation where there was not a particular motivation to setting up the pattern one way or the other, the preference would be to have each injector located between two producers. However as a further example, in a reservoir where injectivity was a problem, in order to avoid fracing/fracturing the reservoir while still getting the same amount of steam into the reservoir, one might want to take the approach of locating each producer between two injectors. However, the main rule to follow in practicing the invention is that while any well is adjacent to a particular well and is on continuous production of fluids, then the particular well in question must be used for continuous injection of fluids; and while any well is adjacent to a particular well and is being used for continuous fluid injection, the particular well in question must be used for continuous fluid production.

In either case, steam is injected at pressures below the fracture pressure of the formation. The method also comprises Continuous Production (CP) occurring at a rate greater than the cumulative rate of CSI. Both the injection of steam and the production of fluids is accomplished using conventional means known in the art.

If the array consists of more than three wells, every second well (i.e., the even-numbered wells) in the array is used as an injector during CSI, and the remaining wells (i.e., the odd-numbered wells or the wells "off-setting" the injectors) are used to continuously produce heavy crude oil. The result is that each well being used for CP is located adjacent to a well being used for CSI, but never adjacent to another well being used for CP (i.e., the CP wells are separated by a CSI well).

If reservoir conditions do not provide immediate injectivity and the heavy crude oil contained with the reservoir is sufficiently mobile to allow production of such oil using conventional means known in the art, then all wells in the array would be produced by such means until sufficient injectivity is created, through the removal of fluid from the reservoir.

Figure 4:
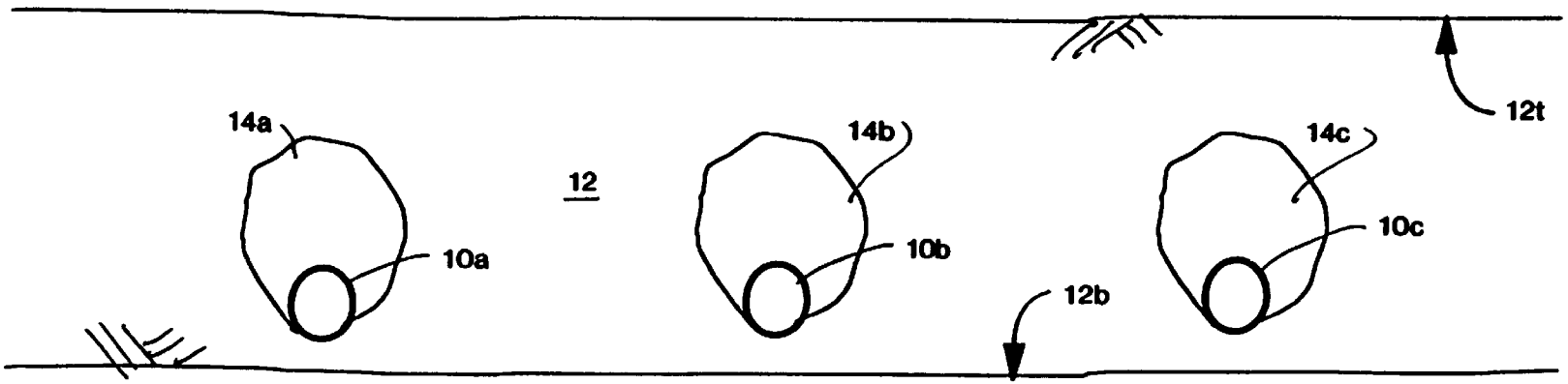
Figure 5:
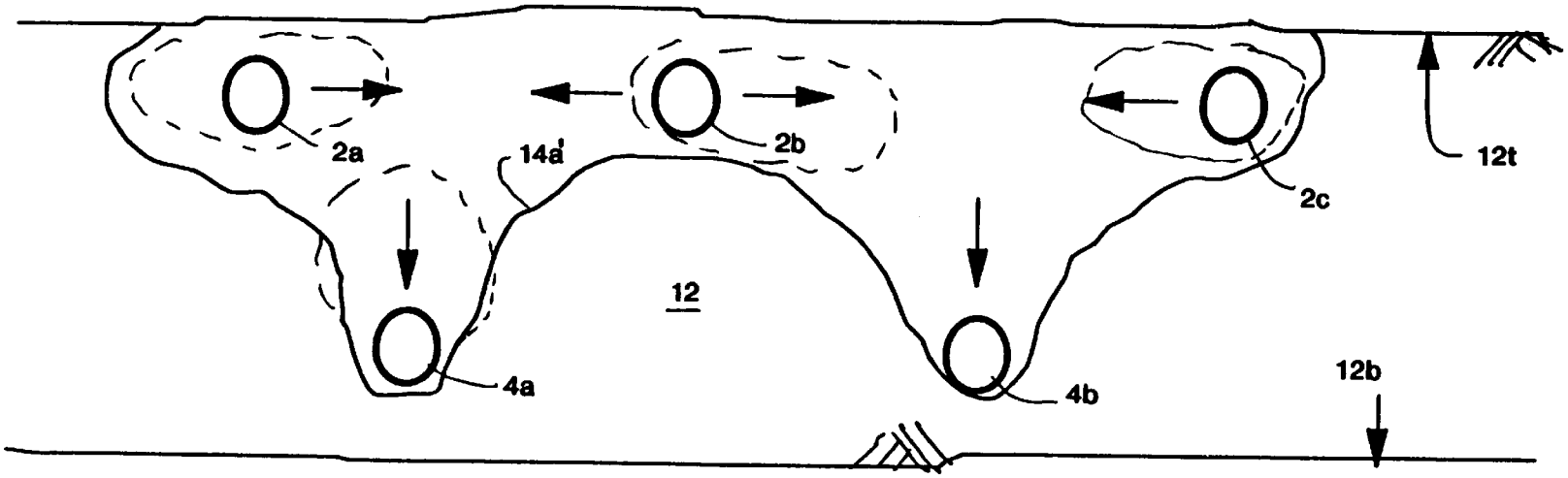
FIGS. 5 and 6 show by cross section the application of CSI to the injection wells as taught by U.S. Pat. No. 5,273,111 (FIG. 5) and as thought by the present invention (FIG. 6), with continuous production from the production wells in both cases.

If reservoir conditions do not provide for satisfactory initial communication between adjacent wells in the array, the present invention teaches the application of CSS to all wells in the array in the following described manner until such communication is established:

Initially, CSS is applied simultaneously to all wells in the array using means that are known in the art, for at least one steam/production cycle to create voidage within the reservoir and provide sufficient injectivity. This causes the formation of steam chambers 14*a,* 14*b* and 14*c* (See FIG. 4) within the reservoir formation 12. Injection pressures are below reservoir fracture pressure. Depending on reservoir conditions and the nature of the heavy crude oil contained therein, further cycles of CSS may be required.

Figure 7:
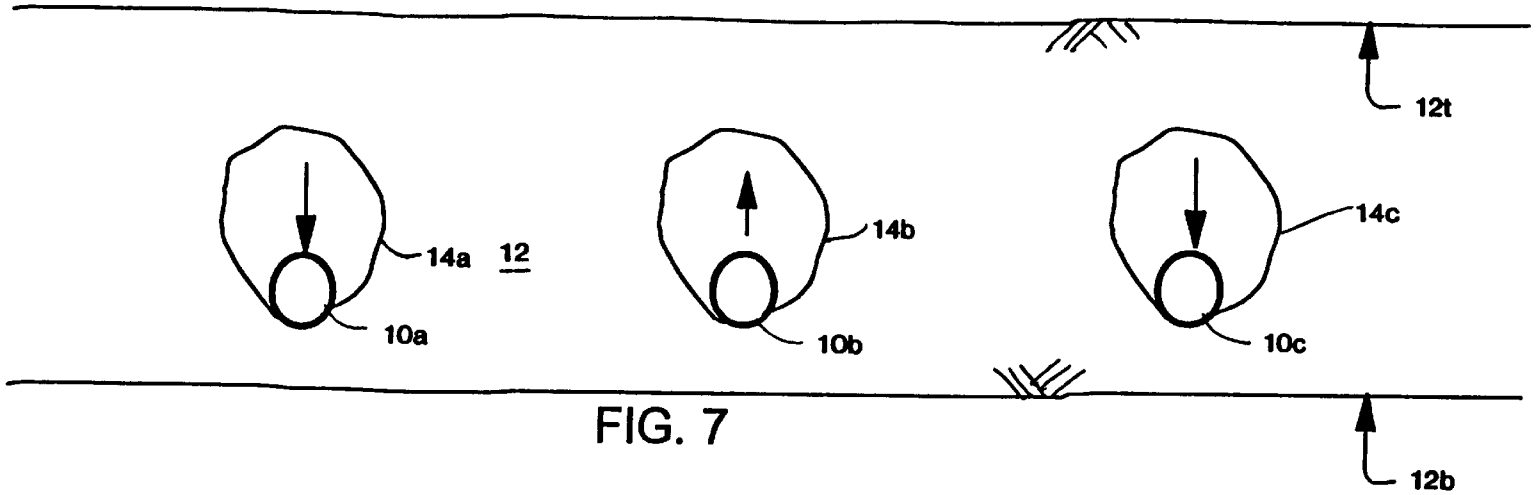
FIGS. 7 and 8 show by cross section the application of CSS to wells drilled in an array as taught by the present invention, with the injection/production phase for each well being out of sync with the wells adjacent to and offsetting such well.
Figure 8:
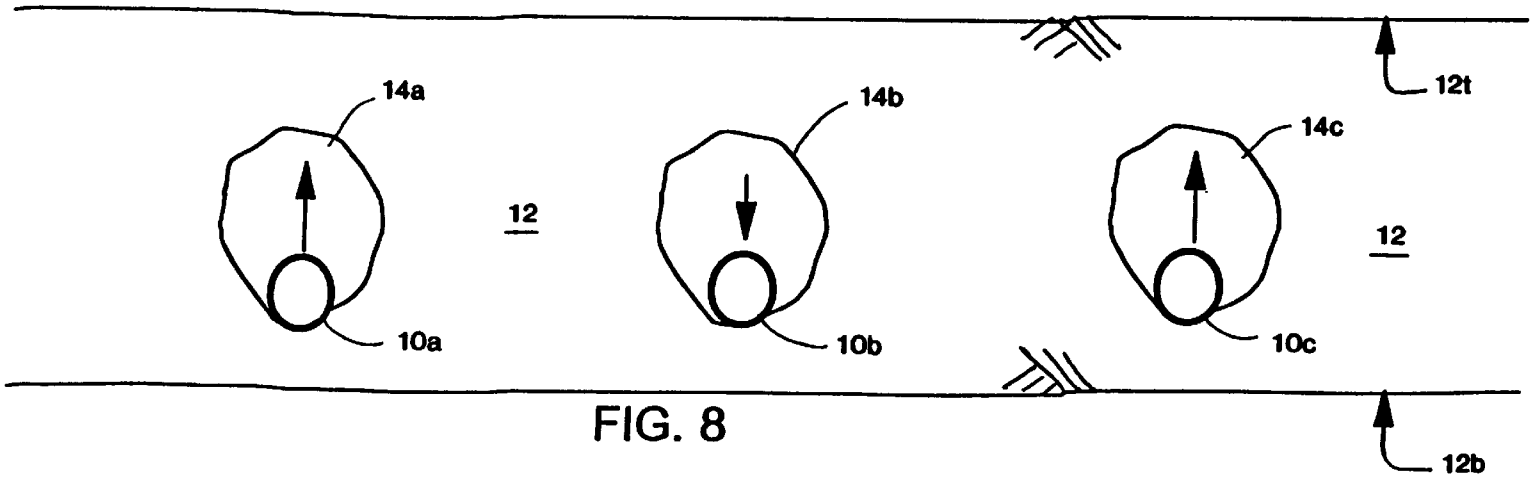

Next, after sufficient injectivity has been achieved, but before satisfactory communication between offsetting wells occurs, CSS of all wells, in the array continues with the steam injection and production cycle being applied to each well, "out of sync" with the well or wells adjacent to such well, so that while steam is being injected through a particular well, production is being taken from adjacent wells (See FIGS. 7 and 8). The vertical arrows denote the direction of fluid flow to and from the wells 10*a,* 10*b* and 10*c*. In FIG. 7 the center well 10*b* is in the injection phase (steam being injected through such well). The wells 10*a* and 10*c* beside it are in the production phase (fluids being produced through such wells). In FIG. 8 the situation is reversed.

By applying CSS in this, fashion (i.e., "out of sync"), the reservoir may be pressured-up and pressurization maintained over the whole period of time that CSS is being applied. If the wells in the array were cycled simultaneously (i.e., "in sync") between the injection and production phases, then, by the end of the production phase, the drop in reservoir pressure, from the level achieved at the end of the injection phase, would occur sooner and would be larger. For example, if all wells in the array were placed on the same phase of CSS and cycled at the same time, clearly a much larger steam generator would be required. More importantly, one would not be able to build and maintain pressure in the reservoir. Consider a single well CSS scheme:

- when the well is on injection, pressure builds in the reservoir, and
- when the well is switched from injection, reservoir pressure is drawn down to, and in some cases past, the point where a pressure increase was achieved from the injection phase.

Now consider a multiple array, where one is trying to maximize the rate and volume of fluid production from each well and encourage thermal/pressure communication:

if you inject or produce all wells the same time, you will eventually get communication; however if you inject and produce adjacent well in an alternate or "out of sync" manner (i.e., while one well is on injection the other is one production) over the entire reservoir, the pressure draw down created by wells on production, will be compensated, in part, by the injection of steam through other wells.

Initially, because the wells are not in communication, the cross well effect will be minimal or may be non-existent; however, over time, this alternate "sucking and blowing" of alternate wells will effect each well when it is on production through the pressure drive created by the wells on injection. In the end thermal/pressure communication will be achieved faster.

There are several other advantages of the process and method of the present invention. By applying CSS out of sync, in the manner described above, the production phase for each well is enhanced. In particular, the injection of steam in the wells adjacent to and offsetting a well undergoing production, will cause the well undergoing production to benefit from the pressure being exerted by the injection of steam in the offsetting wells. This provides greater economic return on the use of CSS. Another important effect of the above described process (i.e., "out of sync CSS"), is to decrease the time required to create satisfactory communication between the adjacent wells in the array. Yet another advantage is that it facilitates a better response on the initiation of CSI and CP, once satisfactory communication is established. A further advantage of the "out of sync CSS" is that small capacity steam generation facilities may be employed, as not all wells in the array are subject to steam injection at the same time.

Once satisfactory communication is achieved, CSI and CP may be commenced with the wells in the array, in the manner described above (See FIG. 6). In particular, steam is injected into the two outer wells 10*a* and 10*c* at a pressure below the fracture pressure of the reservoir using conventional means known in the art. CP from the production well 10*b* is conducted at a rate greater than the cumulative rate of steam injection into the injection wells. One recommended minimum ratio for rate of injection to rate production is 1 to 1.5. However, the ratio can vary significantly depending on the nature of the reservoir, the native viscosity of the heavy crude oil and the type of fluid injected, as long as the rate of fluid production exceeds the rate of injection.

If after conducting CSI and CP in respect of the array as described above, the rate or volume of heavy crude oil produced from the production wells shows unacceptable decline, and indications demonstrate that there is still a significant volume of heavy crude oil lying within the reservoir between the injection and production wells of the array, then additional horizontal wells may be drilled with the horizontal sections thereof being formed between, parallel to and co-planar with the horizontal sections of the existing wells in the array. Such additional wells would be utilized as either injectors for CSI or producers for CP as reservoir conditions require.

From the foregoing description, it will be observed that numerous variations, alternatives and modifications will be apparent to those skilled in the art. Accordingly this description is to be construed as illustrative only and is for the purpose of teaching those skilled in the art the manner of carrying out the invention. Various changes may be made in the shape, materials, size and arrangement of parts. Moreover, equivalent techniques and steps (taken individually or together) may be substituted for those illustrated and described. Parts may be reversed and certain features of the invention may be used independently of other features of the invention. For example, the present invention is not limited to the use of steam in performing CSS or CSI. Cyclic simulation and continuous injection, using any suitable fluid, including solvents and gases, is possible in the practice of this invention. Reference to the use of steam in the above description, while often preferred for a variety of reasons, is by way of example only. Thus, the present invention should not be limited by the details specified or by the specific embodiments chosen to illustrate the invention or the drawings attached hereto. Thus, it will be appreciated that various modifications, alternatives, variations, and changes may be made without departing from the spirit and scope of the invention as defined in the appended claims. It is, of course, intended to cover by the appended claims all such modifications involved within the scope of the claims.

We claim:

1. A method of producing hydrocarbons and associated fluids from a subterranean formation having pre-existing mobility, comprising the steps of:

forming an array of at least three horizontal wells having horizontal sections that are located vertically between the bottom and mid point of the formation, that are located relatively parallel to each other, and that are essentially horizontally co-planar with the horizontal sections of at least two of said wells of said array and with the horizontal section of at least one well of said array located adjacent to and approximately between the horizontal sections of at least two wells of said array, said at least three wells comprising at least a center horizontal section and two adjacent horizontal sections located on each side of said center horizontal section;

injecting a fluid through said two adjacent wells for moving the hydrocarbons from the formation into said center horizontal section, by providing a vertical and horizontal driving force; and producing hydrocarbons and associated fluids from said center well of said array such that the hydrocarbons and associated fluids move to said producing well in combined response to gravity drainage and said vertical and horizontal driving force.

2. The method as set forth in claim 1, wherein said array comprises more than three wells;

wherein the horizontal sections of said wells of said array are located between the bottom and mid point of the formation, are located relatively parallel to one another, and are essentially horizontally co-planar with each other horizontal section;

wherein said fluid is injected through every second horizontal section to provide said vertical and horizontal driving force to move the hydrocarbons and associated fluids within the formation toward the remaining horizontal sections in the array that are not being used for the injection of fluid in the array; and wherein the hydrocarbons and associated fluids are produced through said remaining horizontal sections in combined response to gravity drainage and said vertical and horizontal driving force.

3. The method as set forth in claim 1, wherein said injected fluid is steam; and wherein said steam is injected through said two adjacent horizontal sections for heating the hydrocarbons and associated fluids and for providing a said generally vertical and horizontal driving force so that the heated hydrocarbons and associated fluids move to said producing wells in combined response to gravity drainage and said vertical and horizontal driving force.

4. The method as set forth in claim 1, wherein said injected fluid has a temperature greater than the temperature of the hydrocarbons in the formation for the purpose of heating the hydrocarbons and driving the hydrocarbons toward said center horizontal section in combined response to gravity drainage and to the pressure differentials between said two adjacent horizontal sections and said center horizontal section.

5. The method as set forth in claim 1, wherein at least some of the hydrocarbons are mobile at pre-existing formation conditions; and further comprising the step of:

producing the hydrocarbons that are mobile at the pre-existing formation conditions from said at least three wells in said array, prior to the step of injecting fluids through said two adjacent horizontal sections in said array.

6. The method as set forth in claim 1, wherein said formation is characterized by a set of pre-existing conditions; and wherein said horizontal sections of said wells in said array are spaced sufficiently close to one another as not to preclude pressure and thermal communication between said wells for said set of pre-existing formation conditions.

7. The method as set forth in claim 1, wherein the cumulative rate of production of fluids from the formation through said center horizontal section is greater than the cumulative rate of injection of fluids into the formation through said two adjacent horizontal sections.

8. The method as set forth in claim 1, wherein after the step of forming said array, the following cycle of three steps is performed at least once to initially establish pressure and thermal communication between the wells in said array:

(a) injecting a fluid through all wells in the array, (b) shutting-in said wells for a period of time, and (c) producing hydrocarbons from all wells in said array.

9. A method of producing hydrocarbons from a subterranean formation having a bottom, a mid-point and hydrocarbons and associated fluids that are mobile at pre-existing formation conditions, comprising the steps of:

(a) making an array of at least three horizontal wells having horizontal sections that are located vertically between the bottom and the mid-point of the formation, that are relatively parallel to one another, that are essentially horizontally co-planar with each other, and that are spaced approximately equidistant from each other and at distances conducive to the establishment of thermal and pressure communication between said horizontal sections, said horizontal sections comprising an outer horizontal section;

(b) increasing the injectivity of the formation;

(c) creating pressure and thermal communication between mutually adjacent horizontal sections in said array;

(d) injecting a fluid through said one outer horizontal section of said array; and (e) producing the hydrocarbons and associated fluids through a well having a horizontal section that is immediately adjacent to said one outer horizontal section; and (f) simultaneously injecting said fluid through another horizontal section that is located adjacent to said horizontal section of step (e); wherein the production of hydrocarbons and associated fluids is at a cumulative rate to establish a pressure differential between said wells in said array being used for fluid injection and those wells in said array being used for fluid production; and wherein said cumulative rate of fluid production is greater than the cumulative rate of fluid injection.

10. The method as set forth in claim 9, where in step (d) said fluid is steam; wherein said cumulative rate of fluid production is at least one and a half times said cumulative rate of fluid injection; and wherein hydrocarbons and associated fluids move to said horizontal section of step (e) in response to the combined effects of such pressure differential and gravity drainage created by the reduction in viscosity of the hydrocarbons from injection of steam.

11. The method as set forth in claim 9, wherein step (c) is performed by cyclically injecting fluid and producing fluid through all of said wells in said array in a manner such that each well in said array is cycled "out of sync" with at least one well immediately adjacent to it.

12. The method as set forth in claim 9, wherein step (a) said array comprises more than three wells.

13. The method as set forth in claim 9, wherein step (b) is performed by producing hydrocarbons that are mobile at pre-existing formation conditions.

14. A method of producing hydrocarbons from a subterranean formation, comprising the steps of:

(1) constructing an array of at least three horizontal wells having horizontal sections that are located between the bottom and the mid point of the formation, that are located generally parallel to one another, and that essentially lie in the same horizontal plane, said array comprising at least one center horizontal section and two adjacent horizontal sections located on each side of said center horizontal section;

(2) injecting a fluid through said center horizontal section to provide a vertical and horizontal driving force to move hydrocarbons from the formation into the horizontal sections of said two adjacent horizontal sections; and (3) producing hydrocarbons from the formation through said two adjacent horizontal sections in response to said vertical and horizontal driving force and gravity drainage.

15. The method as set forth in claim 14, where in step (1) said array comprises at least five horizontal sections.

16. The method as set forth in claim 14, where in step (2) said injected fluid is steam and is injected into said array to heat the hydrocarbons in the formation and to provide a driving force such that the heated hydrocarbons move towards said adjacent horizontal sections in combined response to gravity drainage and said vertical and horizontal driving force.

17. The method as set forth in claim 14, where in step (2) said fluid is injected at a temperature greater than the temperature of the hydrocarbons in the formation for the purpose of heating the hydrocarbons; and wherein the hydrocarbons are driven toward said adjacent horizontal sections in said array at least in response to the pressure differentials between said at least three horizontal wells and gravity drainage by the reduction in viscosity of the hydrocarbons from heating by said steam.

18. The method as set forth in claim 14, where in step (2) said fluid comprises means for improving the ability of the hydrocarbons to flow in the formation so that the hydrocarbons more readily flow in response to the force of gravity and the vertical and horizontal driving force provided by the injected fluid.

19. The method as set forth in claim 14, wherein prior to performing step (2), mobile hydrocarbons are produced from each well in said array.

20. The method as set forth in claim 14, where in performing step (1) the horizontal sections of the wells in the array are spaced from one another at less than the maximum distance allowing pressure and thermal communication between such wells for the pre-existing conditions of the formation.

21. The method as set forth in claim 14, where in performing steps (2) and (3) the cumulative rate of production of hydrocarbons from the formation is greater than the cumulative rate of injection of fluids into the formation.

22. The method as set forth in claim 14, wherein prior to performing step (2) the following cycle is synchronously performed on each well to create thermal and pressure communication:

(a) injecting a fluid through each well in the array, (b) shutting-in each of said well, and (c) producing hydrocarbons from each of said wells; and thereafter performing said cycle on each well in a manner such that each well in the array is "out of sync" with at least one well that is located immediately adjacent to it.

23. A method of producing hydrocarbons from a subterranean formation, comprising the steps of:

(a) drilling at least three horizontal wells comprising at least a center well and two adjacent wells, wherein each of said wells has a horizontal section, wherein said horizontal sections of said wells are generally located in the lower-half of the formation and are generally parallel and co-planar with each other, and wherein said horizontal sections of said wells are spaced sufficiently close to establish thermal and pressure communication between said wells;

(b) increasing injectivity in the formation;

(c) establishing communication between said horizontal sections;

(d) injecting a fluid through the horizontal sections of said two adjacent wells; and (e) producing hydrocarbons and associated fluids from said center well, wherein the hydrocarbons and associated fluids are produced at a sufficiently high cumulative rate of production to establish a pressure differential between said wells; and wherein said cumulative rate of fluid production is greater than the cumulative rate of fluid injection, and hydrocarbons and associated fluids move to said producing well in response to the combined effects of the pressure differential created by such greater production rate and gravity drainage created by the reduction in viscosity of the hydrocarbons from injection of fluid.

24. The method as set forth in claim 23, where in performing step (d) steam is injected; and wherein said cumulative rate of fluid production is at least one and a half times the cumulative rate of fluid injection.

25. The method as set forth in claim 23, wherein communication in step (c) is created by cyclically injecting and producing fluid through all of the wells in a manner that each well is synchronized with the wells adjacent to it.

26. The method as set forth in claim 25, wherein after cyclically injecting and producing fluid through all of the wells, said wells are injected and produced in a manner that each well is out of sync with the wells adjacent to it.

27. The method as set forth in claim 23, where in step (b) injectivity is established by producing hydrocarbons which are mobile at pre-existing formation conditions from each well, prior to commencing the injection of fluids through such wells.

28. The method as set forth in claim 23, further including the step of drilling an additional horizontal well having a horizontal section that is located between, generally parallel to and co-planar with two of said horizontal sections of step (a).

29. The method as set forth in claim 28, wherein said additional horizontal well is used to inject said fluid into the formation.

30. The method as set forth in claim 23, further including the step of drilling an additional horizontal well having a horizontal section that is located generally parallel to and co-planar with two of said horizontal sections of step (a).

31. The method as set forth in claim 30, wherein said additional horizontal well is used for the production of hydrocarbons from the formation.

* * * * *

UNITED STATES PATENT AND TRADEMARK OFFICE

CERTIFICATE OF CORRECTION

PATENT NO. : 5,803,171

DATED : September 8, 1998

INVENTOR(S) : William J. McCaffrey, Grant W. Boyd, Andrew J. Fox, Wayne P. Kraus, Bryan D. Weir It is certified that error appears in the above-identified patent and that said Letters Patent is hereby corrected as shown below:

| Col. | Line | |
|---|---|---|
| | | Cover Page, under "United States Patent" reads "McCaffery et al." should read --McCaffrey et al.-- |
| | | Cover Page, "Inventors:" reads "William J. McCaffery" should read --William J. McCaffrey-- |
| 4 | 65 | reads "the array; continuously" should read --the array; (v) continuously-- |
| 5 | 56 | reads "facilitates the use smaller capacity" should read--facilitates the use of smaller capacity-- |
| 6 | 44 | reads "sections wells drilled" should read --sections of the wells drilled-- |

UNITED STATES PATENT AND TRADEMARK OFFICE

CERTIFICATE OF CORRECTION

PATENT NO. : 5,803,171

DATED : September 8, 1998

INVENTOR(S) : William J. McCaffrey, Grant W. Boyd, Andrew J. Fox, Wayne P. Kraus, Bryan D. Weir It is certified that error appears in the above-identified patent and that said Letters Patent is hereby corrected as shown below:

| Col. | Line | |
|---|---|---|
| 6 | 52 | reads "as thought by"<br>should read --as taught by-- |
| 6 | 56 | reads "as thought by"<br>should read --as taught by-- |
| 7 | 8 | reads "is drilled into"<br>should read --as drilled into-- |
| 8 | 35 | reads "of all wells, in the array"<br>should read --of all wells in the array-- |
| 9 | 5 | reads "the other is one production"<br>should read --the other is on production-- |
| 12 | 17 | reads "wherein step (a)"<br>should read --where in step (a)-- |

Signed and Sealed this

Twelfth Day of January, 1999

*Attest:*

*Attesting Officer*

*Acting Commissioner of Patents and Trademarks*